US008273212B2

(12) United States Patent
Snekkenes

(10) Patent No.: US 8,273,212 B2
(45) Date of Patent: Sep. 25, 2012

(54) METHOD FOR KRAFT PULP PRODUCTION WHERE HEMICELLULOSES ARE RETURNED

(75) Inventor: Vidar Snekkenes, Oslo (NO)

(73) Assignee: Metso Paper Sweden AB, Sundsvall (SE)

( * ) Notice: Subject to any disclaimer, the term of this patent is extended or adjusted under 35 U.S.C. 154(b) by 0 days.

(21) Appl. No.: 12/808,367

(22) PCT Filed: Dec. 16, 2008

(86) PCT No.: PCT/SE2008/051473

§ 371 (c)(1),
(2), (4) Date: Jan. 20, 2011

(87) PCT Pub. No.: WO2009/082338

PCT Pub. Date: Jul. 2, 2009

(65) Prior Publication Data

US 2011/0100572 A1 May 5, 2011

(30) Foreign Application Priority Data

Dec. 20, 2007 (SE) ..... 0702874

(51) Int. Cl.

| | |
|---|---|
| ***D21C 3/02*** | (2006.01) |
| ***D21C 3/22*** | (2006.01) |
| ***D21C 3/24*** | (2006.01) |
| ***D21C 11/00*** | (2006.01) |

(52) U.S. Cl. ..... 162/41; 162/7; 162/17; 162/19; 162/29; 162/33; 162/36; 162/82

(58) Field of Classification Search ..... 162/7, 17, 162/19, 29, 33, 36, 41–43, 82
See application file for complete search history.

(56) References Cited

U.S. PATENT DOCUMENTS

| | | | | |
|---|---|---|---|---|
| 3,354,029 | A * | 11/1967 | Aurell et al. | 162/41 |
| 3,802,956 | A * | 4/1974 | Backlund | 162/19 |
| 3,843,473 | A * | 10/1974 | Samuelson et al. | 162/40 |
| 3,937,647 | A * | 2/1976 | Backstrom et al. | 162/16 |
| 5,674,359 | A * | 10/1997 | Chasse et al. | 162/19 |
| 6,030,492 | A * | 2/2000 | Oulie et al. | 162/19 |
| 6,063,238 | A * | 5/2000 | Bergqvist et al. | 162/42 |
| 6,468,390 | B1 * | 10/2002 | Snekkenes et al. | 162/19 |
| 6,576,084 | B1 * | 6/2003 | Stromberg et al. | 162/19 |
| 2003/0131956 | A1 * | 7/2003 | Stromberg | 162/19 |
| 2006/0162880 | A1 * | 7/2006 | Snekkenes | 162/52 |
| 2011/0100572 | A1 * | 5/2011 | Snekkenes | 162/41 |

FOREIGN PATENT DOCUMENTS

CA 823568 9/1969

(Continued)

*Primary Examiner* — Jose A Fortuna
(74) *Attorney, Agent, or Firm* — Rolf Fasth; Fasth Law Offices

(57) ABSTRACT

The method increases the yield and improves the beatability of kraft pulp. During the progression of the cooking process, more than one cooking liquor with a dissolved content of hemicellulose is drawn off and then reintroduced to the last phases of the cooking process, to re-precipitate the hemicellulose on the fibers. The hemicellulose rich cooking liquors are adjusted so that they, upon being added to the last phase of the cooking process are optimized. Early dissolved hemicellulose has a longer chain length than the hemicellulose that dissolves in the cooking liquor in the later phases of the cooking process, and they also have different tendencies to precipitate on the wood chips softened in the cooking process.

10 Claims, 1 Drawing Sheet

FOREIGN PATENT DOCUMENTS

| | | | | |
|---|---|---|---|---|
| EP | 1203841 | A1 | * | 5/2002 |
| EP | 1205597 | A1 | * | 5/2002 |
| SE | 317250 | | | 11/1969 |
| WO | WO9500698 | | | 1/1995 |
| WO | WO0011261 | | | 3/2000 |
| WO | WO 03060229 | A1 | * | 7/2003 |
| WO | WO 03106765 | A1 | * | 12/2003 |
| WO | WO 2004005609 | A1 | * | 1/2004 |
| WO | WO 2009082338 | A1 | * | 7/2009 |

* cited by examiner

METHOD FOR KRAFT PULP PRODUCTION WHERE HEMICELLULOSES ARE RETURNED

PRIOR APPLICATION

This application is a U.S. national phase application based on International Application No. PCT/SE2008/051473, filed 16 Dec. 2008.

The present invention relates to a method for the manufacture of sulphate pulp from disintegrated wood material.

BACKGROUND AND SUMMARY OF THE INVENTION

EP 1115943 (=U.S. Pat. No. 6,468,390) discloses a method for cooking wherein early cooking liquor with a high content of dissolved hemicellulose, mainly in the form of Xylan, is withdrawn from the cooking process, most suitably directly after the end of the impregnation step, and is then reintroduced in the end of the cooking process where the hemicellulose is allowed to precipitate on the softened wood chips by giving it an extended retention time. With this method it is possible to increase the yield by at least 1% and also improve the beatability of the pulp. EP 1115943 discloses in detail the process for selective precipitation of hemicellulose/Xylan and prior art at the date of filing.

U.S. Pat. No. 3,354,029 discloses a process whereby cooking liquor is added to the last 15 minutes of the cooking process and alkalinity is reduced by adding an acid to reduce pH to 11.5-13, so that a precipitation of lignin, so called lignin condensation, and to some extent hemicellulose occurs. The process in EP 1115943 is different from this process in that the object is to precipitate Xylan, and not obtain a lignin condensation at all, since high alkalinity must be maintained in the process.

U.S. Pat. No. 3,937,647 discloses another process where it is only desired to precipitate organic material, i.e. also lignin, where this precipitation process is activated by lowering pH to a value under 11, specifically a pH in the range of 5.5-10.

U.S. Pat. No. 3,802,956 discloses another such process with precipitation in the end of the cooking process with a short retention time allowed for the dissolved organic material together with the softened wood chips.

Upon application of the method according to EP 1115943 it was found that the amount of dissolved hemicellulose during the cooking process varies with time, and that the characteristics of the hemicellulose that has just been dissolved also vary with time. The hemicellulose that has dissolved early in the cooking process begins to degrade, i.e. the hemicellulose in the form of in the Xylan chains is broken down, whereby the yield increasing effect of the Xylan precipitation from the early dissolved Xylan is completely or partly lost. During the cooking process Xylan dissolves easier from the surface of the partly softened wood chips, which is why the likewise early dissolved hemicellulose on average contains longer chains than the hemicellulose which is dissolved later from the interior of the softened wood chips. Among others, Herbert Sixta's "*Handbook of Pulp*", Vol. 1, discloses the rate of dissolution for different kinds of hemicellulose. Xylan is dissolved relatively quickly and after 100 minutes in an alkali cooking process, with a maintained temperature of 170° C., 25% of Xylan has been dissolved after 100 minutes, while 25% of Glucomannan has been dissolved after 200 minutes. Hexenuronic acids are dissolved even more quickly. Already after less than 100 minutes more than 75% has been dissolved from the wood. It is often desirable to remove hexenuronic acids from the pulp because pulp with a high content of Hexenuronic acids is hard to bleach. It is often necessary to use very aggressive bleaching steps with either a high temperature or highly effective bleaching chemicals.

The late dissolved hemicellulose has also been subjected to the high cooking temperature for a longer period of time, a factor that also affects this late dissolved hemicellulose.

To be able to fully optimize a so called Xylan cooking process according to EP 1115943 it has been found suitable to withdraw cooking liquor with the different fractions of early and late dissolved hemicellulose, before these cooking liquors are reintroduced in the end of the cooking process where a selective precipitation of hemicellulose occurs on the softened wood chips, i.e. without any significant lignin precipitation.

These withdrawals of cooking liquor are most suitably performed in combination with the addition of replacement fluid, so that the amount of hemicellulose in the cooking liquor may be diluted and facilitate the dissolving the hemicellulose still bound in the wood chips.

According to the present invention, a first withdrawal is initiated during the cooking process at a position between the later half of the impregnation step and the first quarter of the cooking zone (measured in time), and a second withdrawal is performed later in the cooking zone, where the liquids that have been withdrawn with their contents of dissolved hemicellulose are reintroduced to the last phase of the cooking zone to there be able to precipitate on the wood chips softened in the cooking process. This way it is possible to quickly withdraw the early dissolved hemicellulose, which has a long chain length, and continue to dissolve more hemicellulose in a later phase, whereupon these liquids with the "freshly" dissolved hemicellulose are reintroduced to the last phase of the digester for precipitation on wood chips, when the cleavage of carboxylic acid groups in the Xylan start to reduce the solubility of the Xylan. By withdrawing the primary dissolved hemicellulose early it is possible to prevent that the degradation of Xylan reaches a point where the yield increasing effect is lost.

The invention may be applied on both steam phase digesters and hydraulic digesters, in both single-vessel and two-vessel cooking systems.

DETAILED DESCRIPTION OF PREFERRED EMBODIMENTS

Figure 1:
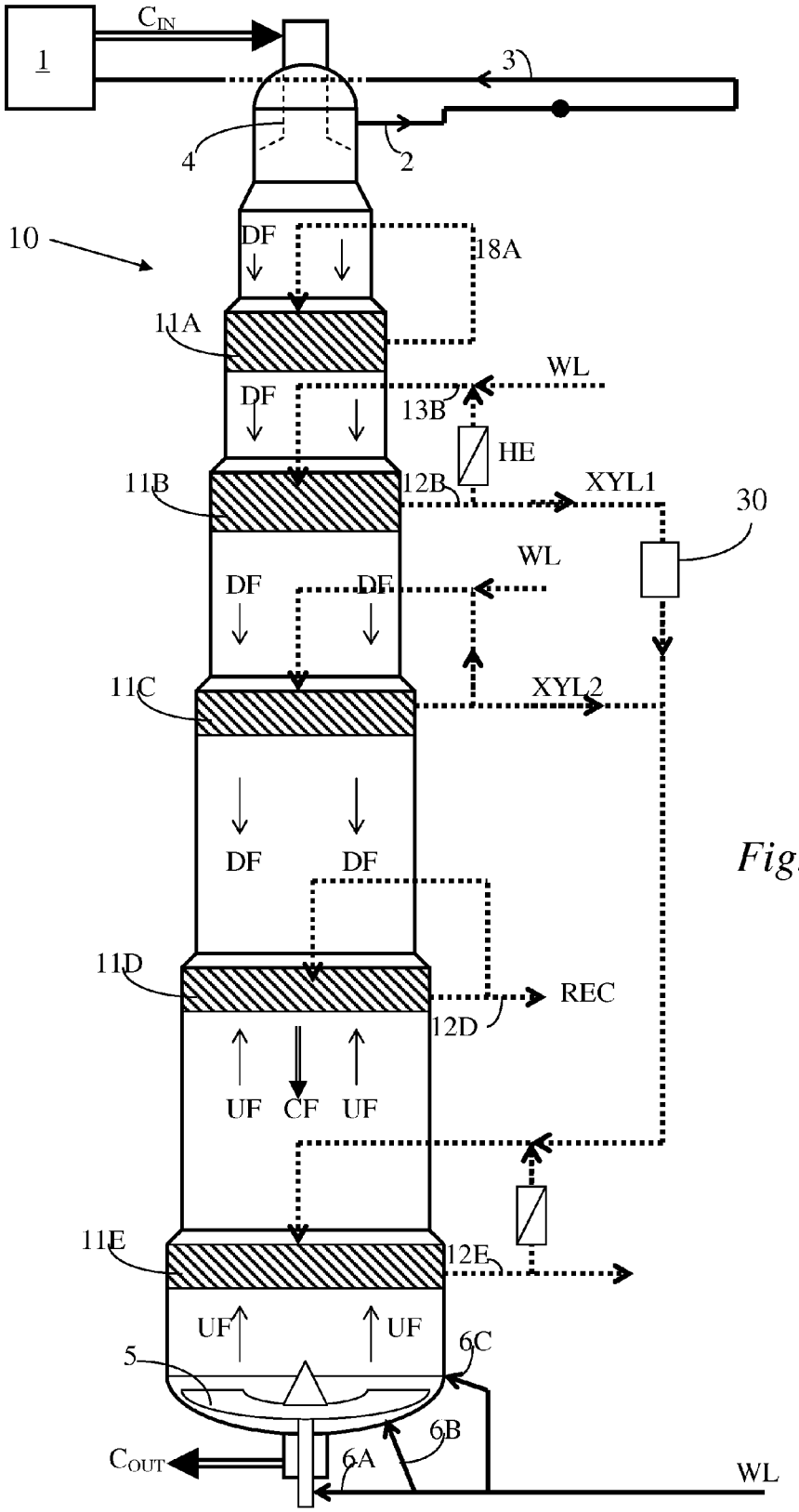
FIG. 1 shows the invention in its simplest embodiment with 5 different treatment zones.

FIG. 1 shows an example of a continuous digester 10 used for the manufacture of sulphate pulp from disintegrated wood material in the form of wood chips. Wood chips $C_{IN}$ are continuously fed into the top of the digester and cooked wood chips $C_{OUT}$ in the form of softened cellulose pulp are fed out continuously from the bottom of the digester. The digester may either be a steam phase digester or a hydraulically filled digester. The invention may be applied in the same way for both these types of digesters.

The wood chips are fed into the top of the digester with a suitable feeding system 1, in the form of a wood chips-liquid mixture, and any, for the cooking process superfluous transport liquid, may be drawn off with a strainer in the top and then be reintroduced into a flow 2 to the feeding system. The feeding system may either be a conventional tap or a sluice feeding valve or pumps, or in some cases a prior filled impregnation vessel which pressurizes the wood chips mixture before being transferred to the top of the digester.

In the figure, the flows of cooking liquors in concurrent treatment zones of the digester are indicated with DF (Down Flow) and counter current treatment zones with UF (Up Flow), and the flow of wood chips is indicated with CF (Chip Flow).

In the upper part of the digester a first impregnation zone may be provided down to the strainer 11B, and optionally a cooking circulation 11A-18A may be provided prior to this, in which circulation the cooking liquor is drawn off through the strainer 11A and reintroduced to the center of the digester via a conventional central tube with pipe 18A.

In the first impregnation zone the wood chips are impregnated with an impregnation liquid at a temperature that is above 80° C. but at the same time below the cooking temperature by at least 20° C. The impregnation should occur at a lower temperature to allow the wood chips to be thoroughly impregnated with cooking liquor and alkali. If the impregnation occurs at a temperature which is too high, the alkali will be spent before it completely reaches the core of the wood chips, which may lead to only partially cooked wood chips and high reject levels (bundles of uncooked wood chip aggregates). The impregnation may in some cases take place completely in a prior impregnation vessel, in a so called two-vessel cooking system. The shown embodiment includes only a single-vessel cooking system. After impregnation, the cooking process is initiated by subjecting the wood chips and cooking liquor to a higher cooking temperature at which initial delignification and bulk delignification occurs. Heating to a cooking temperature may for example be accomplished by a heating circulation, where the cooking liquor is drawn off from the strainer 11 B, and via pipe 12B, heater HE and reintroduction pipe 13, is reintroduced to the center of the digester through a conventional central pipe. Under the strainer 11 B a cooking zone is established at a cooking temperature in the range of 120-170° C., with a predetermined total retention time for the wood material in this cooking zone.

A first withdrawal XYL1, with a first withdrawn cooking liquor, comprising a first amount of hemicellulose dissolved from the wood material, is performed from the cooking process between the later half of the impregnation zone and the first quarter of the cooking zone after the wood material has had a first retention time in these zones, and where this first withdrawn cooking liquor is reintroduced to the last phase of the cooking process at cooking temperature. In the figure this first withdrawal XYL 1 is reintroduced into the circulation 11E, 12E to be introduced into the center of the digester, and allowed to be present in the last cooking zone of the digester, which occurs in an up stream flow up to strainer 11D.

A last wash zone may be established in the bottom of the digester, where diluting or wash liquor is added to the bottom of the digester via a plurality of nozzles 6*b*, 6C and via outlets (not shown) in the bottom scraper 5 of the digester.

In the case a cooking zone is established in the digester it extends from the strainer 11B to the strainer 11E.

The invention is characterized in that a second withdrawal of a second withdrawn cooking liquor XYL2 comprising a second amount of hemicellulose dissolved from the wood material, is done from the cooking zone after the wood material has been allowed a second retention time in the cooking zone, where this second retention time is longer than the first retention time at which the first withdrawal was performed. The second retention time is shorter than the total retention time in the cooking zone. In the figure this second withdrawal XYL2 is also reintroduced to the circulation 11 E, 12E to be reintroduced to the center of the digester, and to be allowed to be present in the last cooking zone of the digester provided in a upstream flow up to strainer 11 D. The final withdrawal of spent black liquor is drawn from the strainer 11 D and is sent to recovery REC, or may alternatively be used as a first impregnation liquor. In the case where the black liquor is sent directly to recovery, the residual alkali content is in the range of 5-10 g/l, typically around 8 g/l, but in the case where the black liquor is used for black liquor impregnation, the residual alkali content is typically 4-6 g/l higher. In both cases, the black liquor will no longer be used in the digester, or in the cooking zone. Some single-vessel digesters comprise a first upper impregnation zone with black liquor in the top of the digester, but this requires an additional withdrawal to recovery directly after this impregnation zone to draw off completely spent black liquor followed by addition of fresh cooking liquor and white liquor.

According to the invention the first retention time for the wood chips between the start of the cooking process (i.e. both the impregnation and cooking zone) and the withdrawal of the first withdrawal XYL1 is shorter than the retention time of the wood chips in the cooking process between the start of the cooking process and the second withdrawal. In the figure XYL1 is drawn off directly at the start of the cooking zone and XYL2 is drawn off partly into the cooking zone.

A suitable first retention time is at least 30 minutes in the cooking process, and for cooking liquor withdrawn in a subsequent withdrawal, these cooking liquors have had increasing retention times between the beginning of the cooking process and the subsequent withdrawal.

The amount of cooking liquor withdrawn is at least 0,5-1,5 cubic meters comprising dissolved hemicellulose from each withdrawal position and reintroduced to the last phase of the cooking process.

Due to the fact that the first dissolved hemicellulose has a longer chain length and has been in the cooking process the shortest time, the first withdrawn cooking liquor XYL1 with a first content of dissolved hemicellulose may be allowed a longer retention time in the last phase of the cooking process than the cooking liquors which have been withdrawn in subsequent withdrawals and which have also been reintroduced to the last phase of the cooking process.

The withdrawn cooking liquor XYL1 of the first withdrawal with a first content of dissolved hemicellulose may also be allowed a longer retention time externally of the digester than the cooking liquors which have been withdrawn in a subsequent withdrawal, prior to the reintroduction of these cooking liquors to the last phase of the cooking process. In this way, the characteristics of the early dissolved hemicellulose will be similar to the characteristics of the later dissolved hemicellulose, so that these, upon addition to the same position in the cooking process behave similarly upon precipitation on the fibers in the digester.

The first withdrawn cooking liquor in the first withdrawal is most suitably withdrawn in a position in the cooking process where the proportion of from the wood material dissolved hemicellulose per unit of time begins to decrease. Initial dissolution of hemicellulose happens relatively quickly, whereupon continued dissolution of hemicellulose from the interior of the wood chips is a longer process.

The withdrawals of cooking liquor with the dissolved content of hemicellulose may occur in more than two positions. In an additional third withdrawal of cooking liquor with a third content of dissolved hemicellulose (not shown), cooking liquor is drawn off from the digester after a third retention time of wood chips in the cooking process, the third retention time being longer than the first and second retention time, whereupon the third cooking liquor is also reintroduced to the last phase of the cooking process.

The withdrawn cooking liquors with their dissolved content of hemicellulose may also first be decompressed to increase the dry content of the cooking liquors, whereupon these cooking liquors are reintroduced to the last phase of the cooking process via pumping/pressurization. In this way water and other volatile liquids and gases may be separated from the cooking liquor, while the proportion of hemicellulose increases in the pressure released cooking liquor. This cooking liquor with its dissolved content of hemicellulose may also be subjected to a separation of its part of hemicellulose, whereupon this separated part of the cooking liquor which is enriched in hemicellulose is reintroduced to the last phase of the cooking process via pumping/pressurization. The separation may be performed by filtration or some other suitable processes. As indicated in FIG. 1, such a separation apparatus 30 may be provided for the withdrawn liquid, which preferably separates at least parts of the dissolved lignin. The separated lignin may then be transferred directly to recovery (REC, not shown). The separation apparatus is shown herein in one of the flows, XYL1, but may also be provided for flow XYL2, or in the combined flow XYL1+XYL2.

The invention may also be modified in a number of ways within the context of the enclosed claims.

The whole digester, or the zone or zones to which the hemicellulose-rich cooking liquor is added, may also be arranged concurrently instead of, as is shown in the figure, as a countercurrent cooking zone where the cooking liquor flows countercurrent to the sinking motion of the wood chips down through the digester.

The cooking process may also be provided in a two-vessel system, where the first impregnation is carried out in a first vessel, and the first withdrawal occurs in the end of this impregnation vessel or during the transfer to the second digestion vessel.

The technique may also be implemented in batch wise cooking, where the cooking liquors rich in hemicellulose are withdrawn at different time points during impregnation or cooking in this digestion vessel, and reintroduced to the later phase of the cooking process, in the same digestion vessel or in a digestion vessel set up in parallel with this and provided later in the cooking process.

Application of the technique does not depend on if the continuous digester is operated as a hydraulic digester (completely filled with cooking liquor) or as a steam phase digester (with a gas phase in the top of the digester).

While the present invention has been described in accordance with preferred compositions and embodiments, it is to be understood that certain substitutions and alterations may be made thereto without departing from the spirit and scope of the following claims.

The invention claimed is:

1. A method for the manufacture of sulphate or kraft pulp from disintegrated wood material, comprising:

impregnating a wood material in an impregnation zone of a cooking process with an impregnation liquor at a temperature which is above 80° C. but below a cooking temperature by at least 20° C., cooking the wood material in a cooking zone of the cooking process at a cooking temperature, the cooking process comprising the impregnation zone and the cooking zone, the wood material being downwardly moving in the cooking process, allowing the wood material a first retention time in the cooking process, the first retention time starting at a start of the cooking process and terminating when the wood material reaches a first position of the cooking process, the first position being located where a proportion of from the wood material dissolved hemicellulose per unit of time starts to decrease, withdrawing a first cooking liquor at the first position, the first cooking liquor comprising a first amount of a first hemicellulose dissolved from the wood material, reintroducing the first cooking liquor to a last phase of the cooking process at the cooking temperature of the first cooking liquor, the last phase being at a lower portion of the cooking process downstream of the first position and a second position, the second position being downstream of the first position, allowing the wood material a second retention time in the cooking process, the second retention time starting at the start of the cooking process and terminating when the wood material reaches the second position of the cooking process, withdrawing a second cooking liquor at the second position, the second cooking liquor comprising a second amount of a second hemicellulose dissolved from the wood material, the second retention time being longer than the first retention time in the cooking process, and reintroducing the second cooking liquor to the last phase of the cooking process.

2. The method of claim 1 wherein the method further comprises the first hemicellulose having a first chain length and the second hemicellulose having a second chain length, the second chain length being shorter than the first chain length, providing the first hemicellulose of the first cooking liquor a longer retention time in the last phase than a retention time of the second hemicellulose of the second cooking liquor in the last phase.

3. The method according to claim 1 wherein the method further comprises making the first retention time at least 30 minutes.

4. The method according to claim 3 wherein the method further comprises drawing off at least 0.5-1.5 cubic meters of cooking liquor with dissolved hemicellulose from each withdrawal position and reintroduced to the last phase of the cooking process.

5. The method according to claim 4 wherein the first cooking liquor is allowed a longer retention time in the last phase of the cooking process than a retention time of the cooking liquors which have been withdrawn in subsequent withdrawals and which are also reintroduced to the last phase of the cooking process.

6. The method according to claim 4 wherein the first cooking liquor is allowed a longer retention time externally of a digester than a retention time of the cooking liquors which have been withdrawn in subsequent withdrawals, before the cooking liquors are reintroduced to the last phase of the cooking process.

7. A method for the manufacture of sulphate or kraft pulp from disintegrated wood material, comprising:

impregnating a wood material in an impregnation zone of a cooking process with an impregnation liquor at a temperature which is above 80° C. but below a cooking temperature by at least 20° C., cooking the wood material in a cooking zone of the cooking process at a cooking temperature in a range of 130-180° C., the cooking process comprising the impregnation zone and the cooking zone, the wood material being downwardly moving through the cooking process, and providing a total retention time of the wood material in the cooking process, allowing the wood material a first retention time in the cooking process, the first retention time starting at a start of the cooking process and terminating when the wood material reaches a first position of the cooking process, the first position being located where a proportion of from the wood material dissolved hemicellulose per unit of time starts to decrease, withdrawing a first cooking liquor at the first position, the first cooking liquor comprising a first amount of a first hemicellulose dissolved from the wood material, the first position being located between a later half of the impregnation zone and a first quarter of the cooking zone, reintroducing the first cooking liquor to a last phase of the cooking process at the cooking temperature of the first cooking liquor, the last phase being at a lower portion of the cooking process downstream of the first position and a second position, the second position being downstream of the first position, allowing the wood material a second retention time in the cooking process, the second retention time starting at the start of the cooking process and terminating when the wood material reaches the second position of the cooking process, withdrawing a second cooking liquor at the second position, the second cooking liquor comprising a second amount of a second hemicellulose dissolved from the wood material, and reintroducing the second cooking liquor to the last phase of the cooking process.

8. The method according to claim 7 wherein a third withdrawal of cooking liquor with a third content of dissolved hemicellulose is drawn off from the digester after a third retention time for the wood chips in the cooking process.

9. A method for the manufacture of sulphate or kraft pulp from disintegrated wood material, comprising:

impregnating a wood material in an impregnation zone of a cooking process with an impregnation liquor at a temperature which is above 80° C. but below a cooking temperature by at least 20° C., cooking the wood material in a cooking zone of the cooking process at a cooking temperature in a range of 130-180° C., the wood material being downwardly moving through the cooking process, and providing a total retention time of the wood material in the cooking process, allowing the wood material a first retention time in the cooking process, the first retention time starting at a start of the cooking process and terminating when the wood material reaches a first position of the cooking process, withdrawing a first cooking liquor at the first position, the first cooking liquor comprising a first amount of a first hemicellulose dissolved from the wood material, the first position being located between a later half of the impregnation zone and a first quarter of the cooking zone, decompressing the first cooking liquor to increase a dry content of the first cooking liquor, reintroducing the decompressed first cooking liquor to a last phase of the cooking process at the cooking temperature of the first cooking liquor, the last phase being at a lower portion of the cooking process downstream of the first position and a second position, the second position being downstream of the first position, allowing the wood material a second retention time in the cooking process, the second retention time starting at the start of the cooking process and terminating when the wood material reaches the second position of the cooking process, withdrawing a second cooking liquor at the second position, the second cooking liquor comprising a second amount of a second hemicellulose dissolved from the wood material, decompressing the second cooking liquor to increase a dry content of the second cooking liquor, and reintroducing the decompressed second cooking liquor to the last phase of the cooking process.

10. A method for the manufacture of sulphate or kraft pulp from disintegrated wood material, comprising:

impregnating a wood material in an impregnation zone of a cooking process with an impregnation liquor at a temperature which is above 80° C. but below a cooking temperature by at least 20° C., cooking the wood material in a cooking zone of the cooking process at a cooking temperature in a range of 130-180° C., the wood material being downwardly moving through the cooking process, and providing a total retention time of the wood material in the cooking process, allowing the wood material a first retention time in the cooking process, the first retention time starting at a start of the cooking process and terminating when the wood material reaches a first position of the cooking process, withdrawing a first cooking liquor at the first position, the first cooking liquor comprising a first amount of a first hemicellulose dissolved from the wood material, the first position being located between a later half of the impregnation zone and a first quarter of the cooking zone, subjecting the first cooking liquor to a separation process to separate out at least parts of dissolved lignin from the first cooking liquor, reintroducing the separated first cooking liquor, enriched with hemicellulose, via pumping/pressurization, to a last phase of the cooking process at the cooking temperature of the first cooking liquor, the last phase being at a lower portion of the cooking zone downstream of the first position and a second position, the second position being downstream of the first position, allowing the wood material a second retention time in the cooking process, the second retention time starting at the start of the cooking process and terminating when the wood material reaches the second position of the cooking process, withdrawing a second cooking liquor at the second position, the second cooking liquor comprising a second amount of a second hemicellulose dissolved from the wood material, decompressing the second cooking liquor to increase a dry content of the second cooking liquor, and reintroducing the separated second cooking liquor to the last phase of the cooking process via pumping/pressurization.

* * * * *